US005894399A

United States Patent [19]

Wong et al.

[11] Patent Number: 5,894,399

[45] Date of Patent: Apr. 13, 1999

[54] ESD CLIP FOR PROTECTING AN ELECTRONIC DEVICE AGAINST ELECTROSTATIC DISCHARGE

[75] Inventors: Ching K. Wong; Franciscus C. Van Dorst, both of Eindhoven, Netherlands

[73] Assignee: U.S. Philips Corporation, New York, N.Y.

[21] Appl. No.: 08/764,835

[22] Filed: Dec. 12, 1996

[30] Foreign Application Priority Data

Dec. 14, 1995 [EP] European Pat. Off. ..... 95203487

[51] Int. Cl.[6] ..... H05F 03/00

[52] U.S. Cl. ..... 361/212; 361/220

[58] Field of Search ..... 361/212, 220

[56] References Cited

U.S. PATENT DOCUMENTS

| | | | |
|---|---|---|---|
| 3,648,108 | 3/1972 | Bailey | 361/212 |
| 3,653,498 | 4/1972 | Kisor | 361/212 |
| 3,774,075 | 11/1973 | Medesha | 361/212 |
| 4,223,368 | 9/1980 | Dattilo | 361/220 |
| 4,754,880 | 7/1988 | Tehrani | 206/723 |
| 5,164,880 | 11/1992 | Cronin | 361/220 |
| 5,599,205 | 2/1997 | Cronin | 361/212 |
| 5,633,780 | 5/1997 | Cronin | 361/220 |

FOREIGN PATENT DOCUMENTS

| | | | |
|---|---|---|---|
| 2348630 | 2/1979 | Germany . | |
| 2-139899 | 5/1990 | Japan | 361/220 |

*Primary Examiner*—Fritz Fleming

[57] ABSTRACT

An ESD clip for protecting an integrated circuit against electrostatic discharge comprises two mutually opposed pressure bodies interconnected by a spring for short-circuiting connection pins of the integrated circuit. The pressure bodies of the ESD clip are pressed against one another by the spring and in that the pressure bodies are coated with an electrically conducting supporting material. Only minimal mechanical moments are thus exerted on the connection wires of an integrated circuit, so that they are not or hardly deformed.

2 Claims, 1 Drawing Sheet

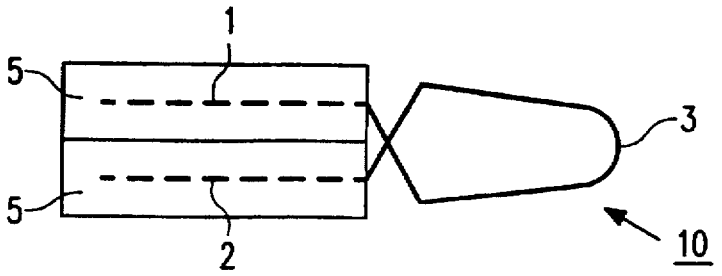
FIG. 1
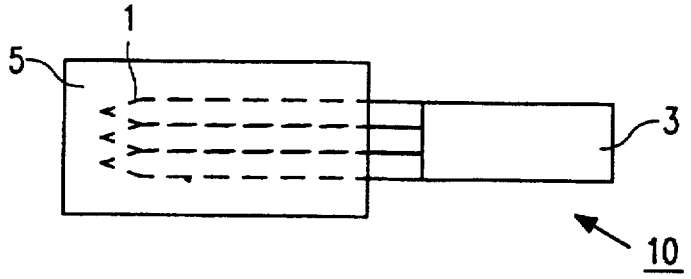
FIG. 2
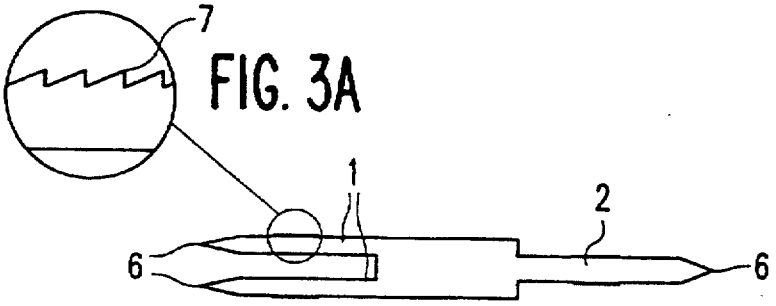
FIG. 3A
FIG. 3
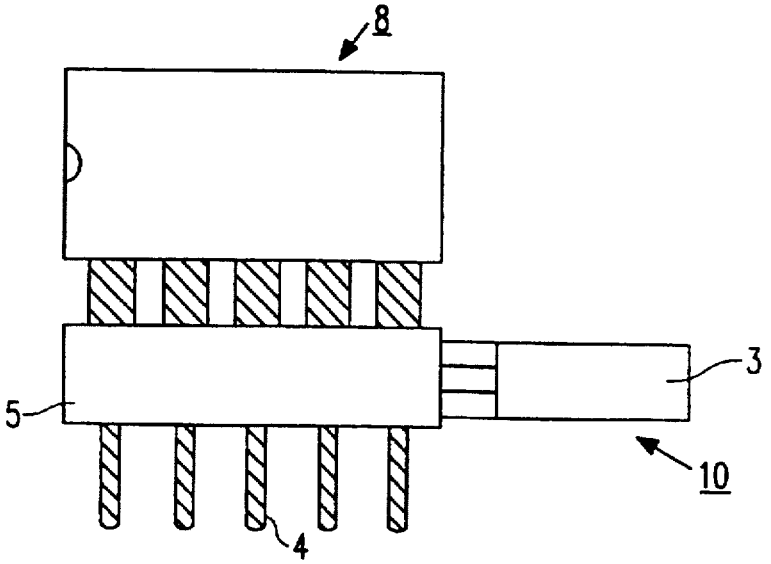
FIG. 4

ESD CLIP FOR PROTECTING AN ELECTRONIC DEVICE AGAINST ELECTROSTATIC DISCHARGE

BACKGROUND OF THE INVENTION

The invention relates to an ESD clip for protecting an electronic device against electrostatic discharge, which clip has two mutually opposed pressure bodies interconnected by a spring for short-circuiting connection wires of the electronic device. The invention also relates to an electronic device with an ESD clip and to a method of protecting an electronic device against electrostatic discharge.

Such a clip is used for protecting an electronic device against ESD ("ElectroStatic Discharge"). Such a discharge may occur when connection wires of an electronic device are gripped and static electricity is transferred from the person gripping the device to the device via the connection wires. Such a discharge may damage an electronic device. The connection wires of the device are short-circuited in practice as a protection against such an electrostatic discharge during handling of the device. The term "connection wires" is here understood to cover conductor tracks which serve to connect the electronic device to the surroundings. These may be, for example, wires, leads of lead frames, and conductor tracks provided on, for example, a synthetic resin foil.

German Patent Application 2348630 discloses a device of the kind mentioned in the opening paragraph. The known ESD clip is a single-part metal structure which comprises the two pressure bodies interconnected by the spring. The pressure bodies comprise as many contact springs as there are connection wires. The known ESD clip is suitable for short-circuiting connection wires of a so-called dual-in-line envelope. A dual-in-line envelope has two parallel rows of connection wires. The known clip is provided over an upper side of the envelope, whereby each of the pressure bodies is pressed against a row of the connection wires.

Owing to the progressing miniaturization, the connection wires of electronic devices are of a comparatively weak construction. Such weak connection wires are deformed when the known clip is used, so that the electronic device is damaged and no longer fits on, for example, a printed circuit board. In addition, the known clip is suitable for dual-in-line envelopes only.

SUMMARY OF THE INVENTION

The invention has for its object inter alia to counteract the above disadvantages.

According to the invention, the ESD clip is for this purpose characterized in that the pressure bodies are pressed against one another by the spring and are coated with an electrically conducting supporting material.

In the known ESD clip, the pressure bodies lie comparatively far apart because these pressure bodies are pressed each against a different row of connection wires. The ESD clip according to the invention is designed for being applied to one row of connection wires. The contact surfaces in the ESD clip according to the invention are pressed against one another, i.e. the pressure bodies touch one another when the ESD clip is not clamped on connection wires. The row of connection wires is clamped between the pressure bodies, a clamping force generated by the spring being transmitted from the one pressure body via the connection wires to the second pressure body. Only minimal mechanical moments are exerted on the connection wires in this manner, so that they are not, or hardly deformed. The pressure bodies of the ESD clip are coated with a conductive supporting or cushioning material. Such a material provides a good contacting of the comparatively weak connection wires because the cushioning material distributes the clamping force satisfactorily and is capable of compensating small unevennesses and deformations of the connection wires. The term "coated" here means that at least that portion of the pressure bodies which is to make contact with connection wires of an electronic device is covered. The ESD clip according to the invention may be used for several types of envelope in that one ESD clip is used for each row of connection wires.

It is noted that also alternative means for protecting an electronic device against electrostatic discharge, for example the insertion of the connection wires into a conductive foam, no longer suffice with the continuing miniaturization because the connection wires are deformed upon being inserted into the foam, so that the electronic device no longer fits, for example, on a printed circuit board.

The electrically conducting, supporting material may comprise a conductive solid synthetic resin. Preferably, the device according to the invention is characterized in that the electrically conducting supporting material comprises a foam or a sponge. Such a foam or sponge provides a very good distribution of the compression forces over the connection wires, so that these wires are not or substantially not deformed, specially in the case of weak connection wires. Electrically conducting foams or sponges are known per se as packaging materials for electronic devices.

In the known ESD clip, the pressure bodies and the spring are manufactured from one piece of an elastically resilient material. The known ESD clip, however, is comparatively large. An additional advantage is obtained when the pressure bodies and the spring are manufactured from one piece of an elastically resilient material, the pressure bodies being constructed as straight strips in mutual opposition and the spring as a curved strip, while the ends of the straight strips of the contact surfaces are connected crosswise to the curved strip of the spring. This crosswise connection renders it possible to open the ESD clip through the application of pressure on the curved strip, so that the clip can be passed over the connection wires. The construction of the ESD clip according to the invention is very compact as a result.

The invention also relates to an electronic device provided with conductive connection wires and an ESD clip for protecting the electronic device against static electricity, the ESD clip interconnecting connection wires of the electronic device electrically. According to the invention, the electronic device is characterized in that the ESD clip comprises two pressure bodies in mutual opposition which are coated with an electrically conducting supporting material and which are pressed towards one another by means of a spring, a clamping force generated by said spring being transmitted from the one pressure body via the connection wires to the second pressure body. Since the pressure bodies lie opposite one another, only minimal mechanical moments are exerted on the connection wires, so that they are not or hardly deformed.

The invention also relates to a method of protecting an electronic device provided with conductive connection wires against static electricity, by which method the connection wires of the electronic device are electrically interconnected. According to the invention, the method is characterized in that an ESD clip with two pressure bodies in mutual opposition which are pressed against one another by means of a spring and are coated with an electrically conducting supporting material, or cushioning material, is placed over the connection wires, such that a clamping force generated by the spring is transmitted from the one pressure body via the connection wires to the second pressure body.

BRIEF DESCRIPTION OF THE DRAWINGS

The invention will be explained in more detail below by way of example with reference to drawings, in which:

FIG. 1 is a side elevation of an ESD clip according to the invention,

FIG. 2 is a plan view of an ESD clip according to the invention,

FIG. 3 is a plan view of a semi-manufactured product in the manufacture of an ESD clip according to the invention, FIG. 3A is a magnified view of a portion of the ESD clip shown in FIG. 3, and FIG. 4 is a plan view of an electronic device provided with an ESD clip according to the invention.

DETAILED DESCRIPTION OF THE PREFERRED EMBODIMENT

The Figures are purely diagrammatic and not true to scale. Corresponding parts have generally been given the same reference numerals in the Figures.

FIGS. 1, 2 and 4 show an ESD clip 10 for protecting an electronic device 8 against electrostatic discharge, which clip comprises two mutually opposed pressure bodies 1, 2 interconnected by a spring 3 for short-circuiting connection wires 4 of the electronic device.

FIGS. 1 and 2 show how according to the invention the pressure bodies 1, 2 are pressed together by the spring 3, which pressure bodies 1, 2 are coated with an electrically conducting supporting material 5.

FIG. 3 is a developed plan view of the ESD clip 10, i.e. a plan view of a component which after doubling over and after the provision of the supporting material will form the ESD clip 10. This Figure shows how the pressure bodies 1, 2 and the spring 3 of the ESD clip 10 are manufactured from one piece of an elastically resilient material, in this case an 0.3 mm thick plate of CrNi steel. The component has two straight strips which will form the pressure body 1 and one straight strip which will form the pressure body 2. The dimensions of the pressure bodies 1 and 2 and of the spring 3 are adapted to the dimensions of the electronic device to be protected. Thus, for example, the total length of the developed component as shown in FIG. 3 is 70 mm, while the width of the two strips forming the pressure body 1 is 1.5 mm. The width of the strip for pressure body 2 is 2.5 mm. The central portion of the developed component which will form a curved strip after doubling over, thus acting as the spring 3, has a length of 18 mm. The component shown in FIG. 3 is doubled over so that a structure as shown in FIGS. 1 and 2 is created. The ends of the straight, mutually opposed strips 1, 2 of the pressure bodies are then connected crosswise to the curved strip of the spring 3 (see especially FIG. 1). This crosswise connection renders it possible to open the ESD clip 10 through the application of a pressure on an upper and a lower side of the curved strip of the spring 3, so that the clip can be passed over the connection wires. The construction of the ESD clip 10 according to the invention is very compact as a result. An additional advantage is that the pressure bodies 1, 2 in this construction contact the connection wires 4 gradually, i.e. starting from an end. The pressure bodies 1, 2 of the ESD clip 10 are coated with a conducting supporting material 5, a so-called cushioning material. Such a material provides a good contacting of the comparatively weak connection wires 4 because the supporting material distributes the clamping force satisfactorily and is capable of compensating for small unevennesses and deformations of the connection wires 4.

The electrically conducting supporting material may be a conductive solid synthetic resin. Such a synthetic resin may be connected to the pressure bodies 1, 2, for example with a glue in those locations which make contact with the connection wires 4. Preferably, however, the electrically conducting supporting material comprises a foam or a sponge. Such a foam or sponge provides a very good distribution of the clamping forces over the connection wires, so that these wires are not or hardly deformed especially in the case of weak connection wires. Electrically conducting foams or sponges are known per se as packaging materials for electronic devices. FIG. 3 shows how such a foam or sponge 5 is connected to the pressure bodies 1, 2 by means of a mechanical anchoring. The pressure bodies 1, 2 are for this purpose provided with sharp tips 6 at their free ends, while in addition projections 7 (shown in more detail in FIG. 3A) are provided in longitudinal direction along an edge of each strip, gripping the foam or sponge 5. The foam or sponge 5 is subsequently impaled on the strip 1, 2. This renders it possible in a simple manner to connect the supporting material 5 to the strips 1, 2 without the use of glue.

FIG. 4 shows how the ESD clip 2 according to the invention is placed on the connection wires 4 of an electronic device 8, a clamping force generated by the spring 3 being transmitted from the one pressure body 1 via the connection wires 4 to the second pressure body 2. An electronic device provided with an ESD clip as a protection against electrostatic discharge via the connection wires 4 is created thereby.

The invention is not limited to the embodiment described above. Thus a certain type of spring interconnecting the two pressure bodies is indicated in the example. It will be obvious that alternative springs, for example such as shown in the known ESD clip, may be used. The conducting supporting material is provided around the strips forming the pressure bodies 1 and 2 in the embodiment. The conducting supporting material may alternatively be provided only on that surface of the strip which will be pressed against the other pressure body. It is also possible to fasten the conducting supporting material as an integral whole or with a certain interval along the longitudinal direction of the pressure bodies. The ESD clip in the example is manufactured from a CrNi steel. Other materials my alternatively be used for the supporting material is electrically conducting and provides the short-circuiting of the connection wires, the basic material of the ESD clip used for the pressure bodies and the spring need not necessarily be electrically conducting.

What is claimed is:

1. An ESD clip for protecting an integrated circuit against electrostatic discharge, which clip has two mutually opposed pressure bodies interconnected by a spring for short-circuiting connection pins of the integrated circuit, characterized in that the pressure bodies are pressed against one another by the spring and are coated with an electrically conducting supporting material, the spring allowing the pressure bodies to be separated in order to envelop and engage the pins of the integrated circuit, and further characterized in that the pressure bodies and the spring are manufactured from one piece of an elastically resilient material, the pressure bodies being constructed as straight strips in mutual opposition and the spring as a curved strip. while the ends of the straight strips of the contact surfaces are connected crosswise to the curved strip of the spring.

2. An ESD clip as claimed in claim 1, characterized in that the electrically conducting supporting material comprises a material selected from one of a foam and a sponge.

* * * * *